US005706970A

United States Patent [19]

Dobler et al.

[11] Patent Number: 5,706,970

[45] Date of Patent: Jan. 13, 1998

[54] ARRANGEMENT OF AN EQUALIZING TANK ON A WATER TANK OF A COOLER

[75] Inventors: Helmut Dobler, Hemmingen; Siegfried Jenz, Illingen, both of Germany

[73] Assignee: BEHR GmbH & Co., Stuttgart, Germany

[21] Appl. No.: 522,533

[22] Filed: Sep. 5, 1995

Related U.S. Application Data

[63] Continuation of Ser. No. 92,051, Jul. 15, 1993, abandoned.

[30] Foreign Application Priority Data

Aug. 3, 1992 [DE] Germany ..... 42 25 253.9

[51] Int. Cl.[6] ..... B65D 17/00

[52] U.S. Cl. ..... 220/501; 220/23.4; 123/41.54

[58] Field of Search ..... 220/501, 562, 220/564, 4.12, 4.13, 4.14, 23.2, 23.4, 23.83, 23.86; 123/41.54

[56] References Cited

U.S. PATENT DOCUMENTS

| | | | |
|---|---|---|---|
| 3,193,041 | 7/1965 | Peras | 123/41.54 |
| 3,374,917 | 3/1968 | Troy | 220/23.4 |
| 3,757,984 | 9/1973 | Barton | 123/41.54 X |
| 4,133,445 | 1/1979 | Mandelbaum | 220/23.4 |
| 4,200,205 | 4/1980 | Ban et al. | 220/501 |
| 4,431,027 | 2/1984 | Sabina, Jr. | 220/501 X |
| 4,580,622 | 4/1986 | Sigonneau | 123/41.54 X |
| 4,763,724 | 8/1988 | Temmesfeld et al. | 123/41.54 X |
| 4,953,631 | 9/1990 | Kimura | 123/41.54 X |

FOREIGN PATENT DOCUMENTS

| | | |
|---|---|---|
| 0 280 107 | 2/1988 | European Pat. Off. . |

*Primary Examiner*—Steven M. Pollard
*Attorney, Agent, or Firm*—Foley & Lardner

[57] ABSTRACT

For fastening an equalizing tank of plastic material on a water tank made of plastic material, a three-point or multi-point mating connection is provided. The multipoint mating connection is joined together in the horizontal direction and includes a mating point situated in the region of an end wall of the equalizing tank and two or more mating points which are situated at a distance therefrom and from one another, preferably in the region of the bottom of the equalizing tank.

18 Claims, 3 Drawing Sheets

FIG.1
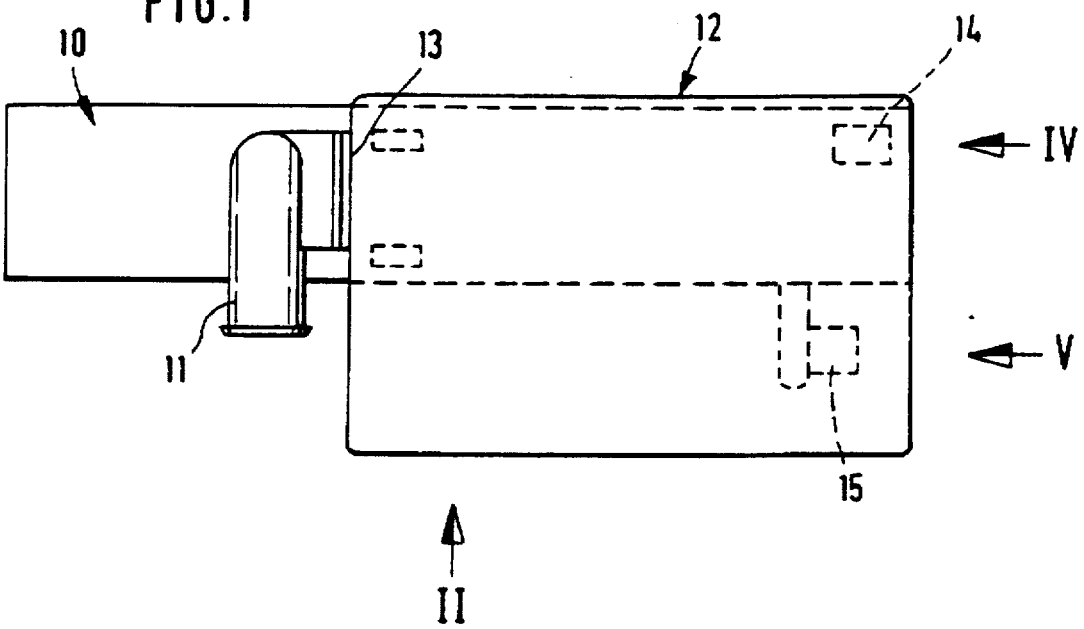
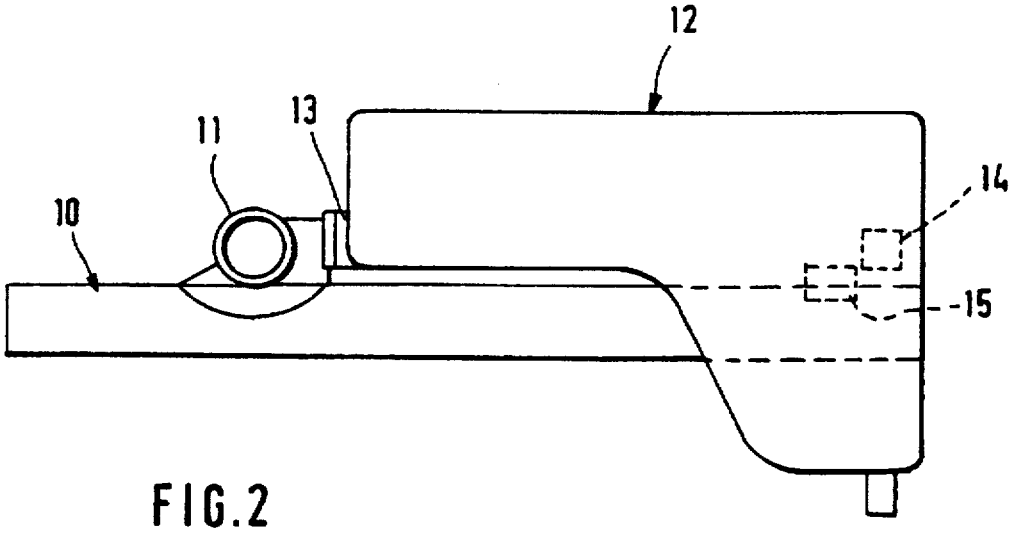
FIG.2

ARRANGEMENT OF AN EQUALIZING TANK ON A WATER TANK OF A COOLER

This application is a Continuation of application Ser. No. 08/092,051, filed Jul. 15, 1993, now abandoned.

BACKGROUND OF THE INVENTION

The invention relates to the arrangement of an equalizing tank made of plastic material on a water tank made of plastic material. The water tank is part of a cooler and the tanks are joined by means of a mating and catch connection.

It is known (EP 0 280 107 A1) to attach an equalizing tank of plastic material to a water tank by means of a mating and catch connection. This mating and catch connection has two mating points, each of which comprises interengageable connection pins and associated catch hooks and catch eyes.

SUMMARY OF THE INVENTION

An object of the present invention is that of providing an arrangement of the type first mentioned above, which permits easy assembly and, in addition, also permits a secure connection between the water tank and the equalizing tank if the latter has a shape which is asymmetrical in relation to the longitudinal axis of the water tank.

This object and other objects and advantages of the present invention are realized by an apparatus which includes a first tank having an end wall and a bottom and three mating points, one mating point being located in the region of the end wall and two mating points being located distant from the one mating point and distant from each other in the region of the bottom of the first tank; and a second tank having three mating points; wherein the first and second tanks are joined together by mating connections formed between respective mating points.

Preferably, the second tank includes a laterally projecting cantilever arm and a mating point is located in the region of the laterally projecting cantilever arm.

The second tank may also include an extension projecting upward above the second tank wherein the mating point located in the region of the end wall of the first tank mates with a mating point disposed laterally on the extension.

The mating point between the end wall of the first tank and the extension of the second tank preferably includes at least two tubular plug-in elements inserted one into the other to form a through passage for liquid between the first tank and the second tank.

Further objects, features, and advantages of the present invention will become apparent from the following description taken in conjunction with the attached drawings.

BRIEF DESCRIPTION OF THE DRAWINGS

The drawings are hereby expressly made a part of the specification.

FIG. 1 shows schematically a plan view of an arrangement of an equalizing tank on the top part of a water tank of a cooler;

FIG. 2 is a side view of the embodiment according to FIG. 1, in the direction of the arrow (II) in FIG. 1;

DETAILED DESCRIPTION OF THE PREFERRED EMBODIMENTS

Figure 3:
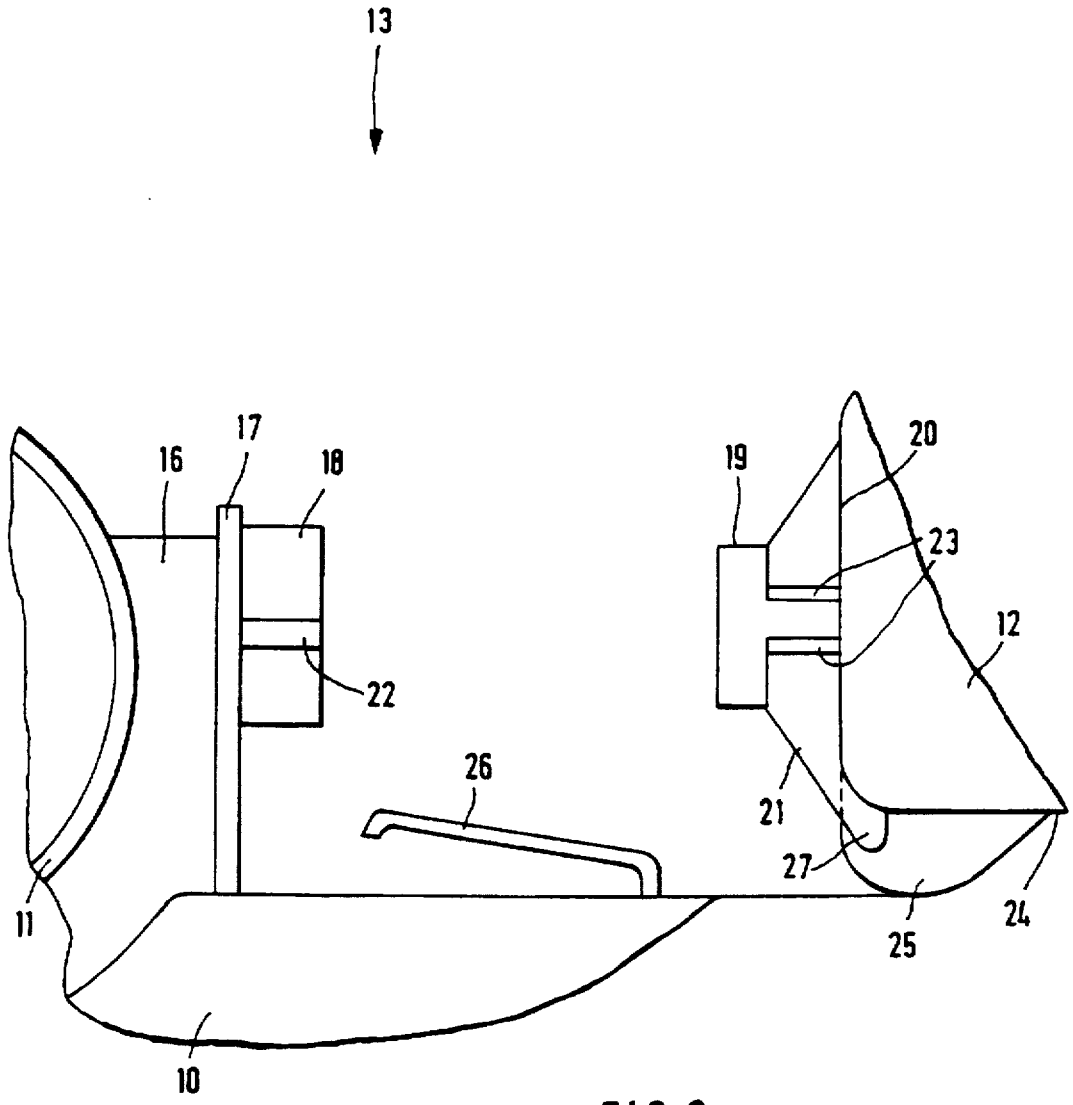
FIG. 3 is a side view of a mating point situated in the region of an end face of the equalizing tank, on a larger scale, before the mating.

The present invention provides a mating connection comprising three or more points which can be joined together in the horizontal direction and which contains a mating point situated in the region of an end wall of the equalizing tank and at least two mating points situated at a distance therefrom and from one another in the region of the bottom of the equalizing tank.

A mating connection of this kind permits secure support of an equalizing tank without it being possible for tilting moments to act to a noteworthy extent on any of the mating points. It is thus also possible for equalizing tanks which project outward relative to the water tank to be securely supported.

As a development of the invention, the water tank is provided with a laterally projecting cantilever arm, in the region of which one of the mating points is disposed. In this way the base of the mating connection can be widened, so that secure mounting is ensured even for equalizing tanks having a relatively large irregular volume distribution.

As a further development of the invention, provision is made for the mating point situated in the region of the end wall of the equalizing tank to be disposed laterally on an extension projecting upward above the water tank. A mating point of this kind is particularly suitable for a liquid connection between the equalizing tank and the water tank.

As a further development of the invention, provision is made for the equalizing tank to be secured, in the region of the mating point associated with its end wall, oppositely to the mating direction by means of at least one catch device. This is expedient in particular when a through connection for liquid is provided in the region of this mating point. This through connection for liquid must be sealed by one or more sealing rings, the correct loading of which is then ensured by means of the catch device without different thermal expansions of equalizing tanks and water tanks affecting the sealing action.

As a further development of the invention, a mating connection consisting of a tongue and groove is provided at the side of plug-in elements on the water tank and the end wall of the equalizing tank, and extends transversely to the direction of the force of a resilient locking tongue. It is thus ensured that the force of one or more locking tongues cannot affect the sealing action of sealing rings.

To achieve secure mating in the region of the mating point associated with the end wall of the equalizing tank and not obstructed by a locking tongue, as a further development of the invention, provision is made for the bottom of the equalizing tank to be provided, in the region of the end wall provided with the plug-in element, with at least one skid associated with the upper face of the top part of the water tank. Because of the distance between the skid and the plug-in element, which corresponds to the distance from the upper face of the top part of the water tank to the plug-in element mounted thereon, a defined mating movement is ensured.

In a further development of the invention, provision is made for the two mating points preferentially associated with the bottom of the equalizing tank to be offset in the mating direction relative to one another. The mating operation as a whole is thereby facilitated, because the mating begins at the mating point associated with the end wall of the equalizing tank and at one of the other two mating points, so that thereupon alignment to the third or other mating point is possible in a simple manner.

In a further development of the invention provision is made for a mating point situated in the region of the bottom of the equalizing tank to be in the form of a fixed bearing acting in the vertical and horizontal directions transversely to the mating direction, and for the other mating point to be in the form of a movable bearing resilient horizontally transversely to the mating direction. It is thereby ensured that when different plastic materials are used for the water tank and for the equalizing tank, and/or if temperature differences occur it will be possible for corresponding thermal expansions to be balanced and absorbed in a simple manner.

The arrangement shown in FIG. 1 and 2 comprises the top part (10) of a water tank of a water-air cooler, particularly for the cooling system of an internal combustion engine of a commercial vehicle. The top part (10) is connected in a manner not illustrated to a tube bottom which receives the tubes of a tube-fin block, on the opposite side of which a bottom water tank is disposed. From the upper face of the top part (10) a transversely directed connecting branch (11) projects, which is in the form of a hose connection. The top part (10) is made of plastic material, particularly of a glass fiber-reinforced polyamide.

Figure 5:
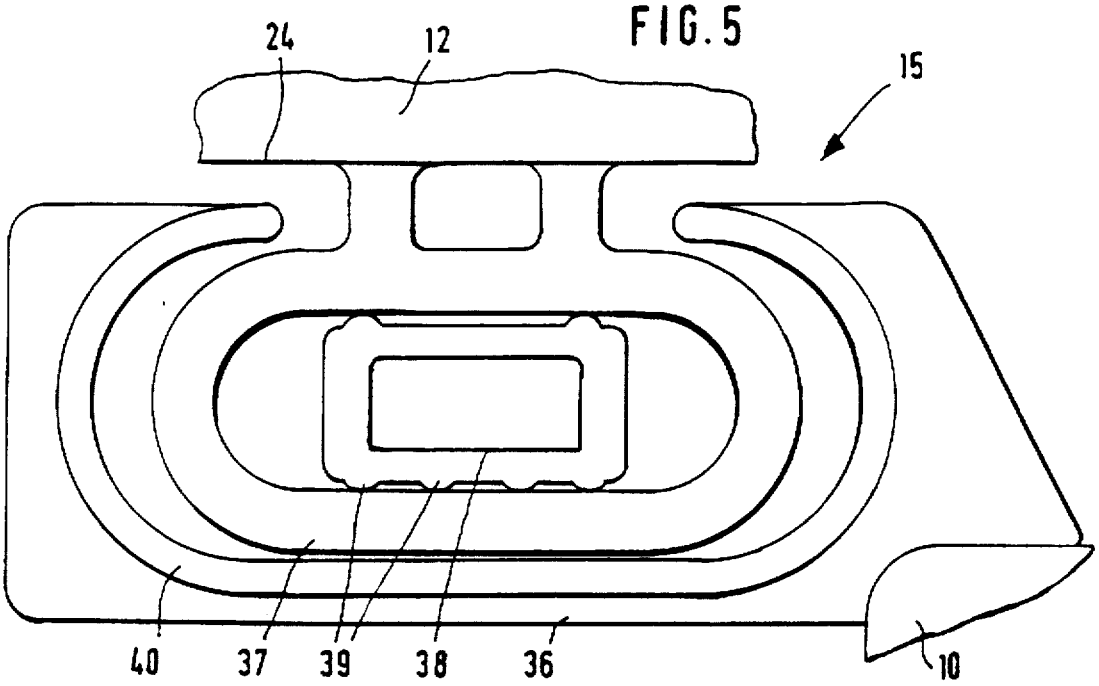
FIG. 5 is a view in the direction of the arrow (V) of a third mating point, shown on a larger scale.

The arrangement further includes an equalizing tank (12), which is fastened to the top part by means of a three-point mating connection. This three-point mating connection comprises three mating points (13, 14, 15), which are merely indicated in FIGS. 1 and 2 but which will be explained in detail later on with reference to FIGS. 3–5. The equalizing tank (12) is likewise made of plastic material, for example of polypropylene. The three-point mating connection is so shaped that mating is effected in the horizontal direction, in the direction of the longitudinal axis of the top part (10), that is to say in the direction of the arrows IV and V in FIG. 1. At the same time a catch connection is made, so that the equalizing tank (12) is secured on the top part (10) against accidental detachment.

The mating point (13), which is illustrated in detail in FIG. 3, has a configuration such that a through passage for liquid exists between the equalizing tank (12) and the top part (10) of the water tank. A widening (16) is formed on the connecting branch (11) and ends in a flange (17) which projects vertically upward from the top part (10). From this flange (17) a plug-in element (18), which is in the form of a tube branch and contains a through bore leading to the connecting branch (11) or the widening (16), projects horizontally. A plug-in element (19), the diameter of which matches the inside diameter of the plug-in element (18) and which projects from an end wall (20) of the equalizing tank (12), can be plugged into said plug-in element (18). The plug-in element (19) has a through bore leading to the equalizing tank (12). Sealing rings (not shown), which lie in the mating direction against corresponding annular shoulders on the respective other element, are provided for the end faces of the plug-in elements (18, 19).

At the side of the plug-in element (19) of the equalizing tank (12) outwardly projecting ribs (21) are disposed which on mating bear against the flange (17) of the top part and thus limit the mating movement. At the side of the plug-in element (18) webs (22) projecting from the flange (17) are formed, which on mating penetrate into grooves in the ribs (21) provided on the equalizing tank (12) and bounded by top and bottom transverse webs (23).

On the bottom (24) of the equalizing tank a skid (25) is formed on both sides of the plug-in element (19), and these skids are supported on the upper face of the top part (10) when mating takes place, the distance between the skids and the grooves of the ribs (21) corresponding to the distance from the webs (22) to the upper face of the top part (10). It is thereby ensured that in the vertical direction the two plug-in elements (18, 19) are in alignment with one another during mating, so that the risk of damage to the sealing rings during mating is largely eliminated.

From the upper face of the top part (10) locking tongues (26) formed thereon project on both sides of the plug-in element (18) and are shaped after the style of leaf springs, their ends engaging behind catch beaks (27) which are formed on the equalizing tank (12) and project from the bottom 24 of the latter.

The mating point (13) is the only mating point of the entire mating connection in the region of which locking is effected by means of a catch. Different thermal expansions cannot attain substantial values in the region of this mating point (13), so that equalization is possible without difficulty. As will be further explained later on, the other two mating points (14, 15) allow even relatively large equalization movements.

Figure 4:
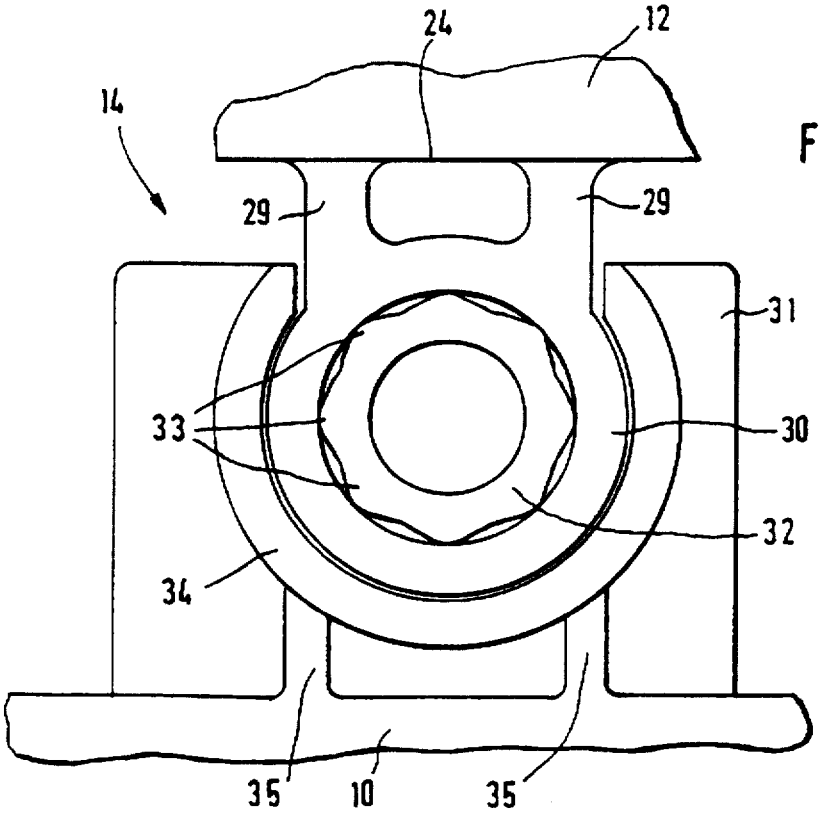
FIG. 4 is a view in the direction of the arrow (IV) in FIG. 1 of a second mating point shown on a larger scale.

The mating point (14), which is shown in detail in FIG. 4, is in the form of a fixed bearing which acts in the vertical and horizontal directions but permits relative movements in the mating direction. On the bottom (24) of the equalizing tank (12) a roughly tubular slide guide (30) is formed by means of webs (29) and lies at a distance underneath the bottom (24), its axis pointing in the mating direction. On the top part (10) a transverse web (31) is formed, from which a pin (32) projects in the mating direction, the outer periphery of said pin being provided with longitudinal ribs (33) which have a roughly semicircular cross-section. Together with the slide guide (30) the outer surface of the longitudinal ribs (33) makes a sliding fit. An enclosing frame (34) surrounding the slide guide (30) projects from the transverse web (31), being connected by webs (35) to the top part (10). The enclosing frame (34), which is slotted at its top side, serves as an aid to insertion.

The mating point (15) is situated underneath the bottom (24) of the equalizing tank (12) and in the region of a cantilever arm (36) which projects transversely from the top part (10) of the upper water tank, being formed on said top part (10). On the bottom (24) of the equalizing tank (12) a slide guide (37) is formed by means of webs and extends in the mating direction, its cross-section being oval. The larger cross-sectional dimension extends in the horizontal direction. In this slide guide is guided a pin (38) which has a rectangular cross-section and projects in the mating direction from the cantilever arm (36). This pin (38) is provided on its upper face and on its lower face with longitudinal ribs (39) which have a semicircular cross-section and together with the parallel upper and lower faces of the slide guide (37) form a slideway. Between the pin (38) and the slide guide equalizing movements are therefore possible in the horizontal direction. The slide guide (37) is surrounded by an enclosing frame (40) which has a longitudinal slot on its upper side and is formed on the cantilever arm (36), and which contributes toward stiffening the latter, while in addition aiding insertion.

The three-point mating connection comprising the mating points (13, 14, 15), which, in plan view, lie at the corners of a triangle, permits secure supporting of the equalizing tank (12) on the top part (10) of the upper water tank, wherein no tilting moments act on the mating points even if the equalizing tank, which has a relatively large volume, has a configuration asymmetrical in relation to the longitudinal axis of the top part (10), as is the case in the embodiment according to FIG. 1 and 2.

While the invention has been described with reference to a preferred embodiment, numerous alterations, modifications, and changes to the described embodiment are possible without departing from the spirit and scope of the invention, as defined in the appended claims and equivalents thereof.

What is claimed is:

1. An apparatus, comprising:

a first tank having an end wall and a bottom and three mating points, one mating point being located in a region of the end wall and two mating points being located in a region of the end wall and two mating points being located distant from the one mating point and distant from each other in a region of the bottom of the first tank;

a second tank having three mating points, the first and second tanks being joined together by mating connections formed between respective mating points, wherein one of the mating connections between the end wall of the first tank and an extension of the second tank includes at least two tubular plug-in elements inserted one into the other to form a through passage for liquid between the first and the second tank; and at least one catch device for securing the first tank in a direction opposite to the mating direction, the catch device being located in the region of the end wall mating point, wherein the catch device includes at least one resilient locking tongue located on an upper face of the second tank and a catch beak located in the bottom region of the first tank and wherein the resilient locking tongue engages the catch beak.

2. The apparatus of claim 1, wherein the first and second tanks are joined together in a horizontal direction.

3. The apparatus of claim 1, wherein the first tank includes an equalizing tank, the second tank includes a water tank of a cooler, and the equalizing tank is mounted on the water tank.

4. The apparatus of claim 3, wherein the first and second tanks are made of a plastic material.

5. The apparatus of claim 1, wherein the second tank includes a laterally projecting cantilever arm and a mating point is located in the region of the laterally projecting cantilever arm.

6. The apparatus of claim 1, wherein the second tank includes an extension projecting upwards above the second tank and wherein the mating point located in the region of the end wall of the first tank mates with a mating point disposed laterally on the extension.

7. The apparatus of claim 6, wherein the extension of the second tank includes a connecting branch.

8. The apparatus of claim 1, wherein the mating point between the end wall of the first tank and the extension of the second tank comprises, at each of the plug-in elements, a mating connection including a groove and a second tongue and wherein the mating connection extends transversely to the direction of a locking force of the resilient locking tongue.

9. The apparatus of claim 1, wherein the first tank further comprises, in the bottom region of the first tank, in the region of the end wall provided with the plug-in element, at least one skid which engages an upper face of a top part of the second tank.

10. The apparatus of claim 1, wherein the mating points located in the bottom region of the first tank are offset in the mating direction relative to one another.

11. The apparatus of claim 10, wherein the two mating points located in the bottom region of the first tank include one mating point in the form of fixed in the vertical and horizontal directions transversely to the mating direction, and another mating point in the form of a joint which is horizontally moveable transversely to the mating direction.

12. The apparatus of claim 11, wherein the mating point in the form of a fixed joint includes a pin and a slide guide which are aligned in the mating direction and wherein the pin engages the slide guide.

13. The apparatus of claim 12, wherein the mating point in the form of a movable joint includes a second pin and a second slide guide which are aligned in the mating direction and wherein the second pin engages the second slide guide and the second slide guide guides the second pin in the horizontal direction.

14. The apparatus of claim 13, wherein the pin and the second pin include, on their outsides, ribs which extend in the mating direction.

15. A radiator, comprising:

an equalizing tank having an end wall and a bottom, and three mating points, one mating point being located in a region of the end wall and two mating points being located distant from the one mating point and distant from each other in a region of the bottom of the equalizing tank; and a fluid tank having three mating points, the equalizing tank and the fluid tank being detachably joined together by mating connections formed between respective mating points, wherein one of the mating connections between the end wall of the equalizing tank and an extension of the fluid tank includes at least two tubular plug-in elements inserted one into the other to form a through passage for liquid between the equalizing tank and the fluid tank; and at least one catch device for securing the equlizing tank in a direction opposite to the mating direction, the catch device being located in the region of the end wall mating point, wherein the catch device includes at least one resilient locking tongue located on an upper face of the fluid tank and a catch beak located in the bottom region of the equalizing tank and wherein the resilient locking tongue engages the catch beak.

16. The radiator as recited in claim 15, wherein the equalizing tank is substantially asymmetrical in shape with respect to the longitudinal axis of the fluid tank.

17. A cooling system for an engine, comprising:

a radiator having a fluid tank and an equalizing tank, wherein the equalizing tank includes an end wall and a bottom, and three mating points, one mating point being located in a region of the end wall and two mating points being located distant from the one mating point and distant from each other in a region of the bottom of the equalizing tank, the fluid tank includes three corresponding mating points, the equalizing tank and the fluid tank are detachably joined together by mating connections formed between the three mating points of the equalizing tank and the three corresponding mating points of the fluid tank, and one of the mating connections between the end wall of the equalizing tank and an extension of the fluid tank includes at least two tubular plug-in elements inserted one into the other to form a through passage for liquid between the equalizing tank and the fluid tank; and at least one catch device for securing the equalizing tank in a direction opposite to the mating direction, the catch device being located in the region of the end wall mating point, wherein the catch device includes at least one resilient locking tongue located on an upper face of the fluid tank and a catch beak located in the bottom region of the equalizing tank and wherein the resilient locking tongue engages the catch beak.

18. The cooling system for an engine as recited in claim 17, wherein the equalizing tank is substantially asymmetrical in shape with respect to a longitudinal axis of the fluid tank.

* * * * *